United States Patent [19]

Kyochika et al.

[11] Patent Number: 4,732,697

[45] Date of Patent: Mar. 22, 1988

[54] DETERGENT COMPOSITION FOR CLEANING DYEING MACHINE

[75] Inventors: Naoki Kyochika; Shigeru Nagao, both of Wakayama, Japan

[73] Assignee: Kao Corporation, Tokyo, Japan

[21] Appl. No.: 857,917

[22] Filed: Apr. 30, 1986

[30] Foreign Application Priority Data

May 17, 1985 [JP] Japan ..... 60-105675

[51] Int. Cl.[4] ..... C11D 11/00

[52] U.S. Cl. ..... 252/174.24; 252/174.21; 252/549; 252/558

[58] Field of Search ..... 252/174.24, 174.21, 252/549, 558

[56] References Cited

U.S. PATENT DOCUMENTS

| | | | |
|---|---|---|---|
| 4,002,571 | 1/1977 | Anderbe et al. | 252/174.24 |
| 4,490,271 | 12/1984 | Spadini et al. | 252/174.24 |
| 4,521,253 | 6/1985 | Barabas | 252/174.24 |
| 4,537,709 | 8/1985 | Edge et al. | 252/558 |
| 4,559,159 | 12/1985 | Denzinger et al. | 252/174.24 |
| 4,578,209 | 3/1986 | Hisamoto et al. | 252/558 |
| 4,586,962 | 5/1986 | Barabas | 252/174.24 |
| 4,612,058 | 9/1986 | Geke et al. | 252/558 |

FOREIGN PATENT DOCUMENTS

| | | |
|---|---|---|
| 0025551 | 3/1981 | European Pat. Off. . |
| 0130640 | 1/1985 | European Pat. Off. . |
| 1528592 | 10/1978 | United Kingdom . |
| 2006811 | 5/1979 | United Kingdom . |
| 1585208 | 2/1981 | United Kingdom . |
| 2138439 | 10/1984 | United Kingdom . |
| 2151252 | 7/1985 | United Kingdom . |

*Primary Examiner*—Paul Lieberman
*Assistant Examiner*—Willie J. Thompson
*Attorney, Agent, or Firm*—Flynn, Thiel, Boutell & Tanis

[57] ABSTRACT

A detergent composition, suitable to clean a dyeing machine, comprises (a) a water-soluble or water-dispersible polymer of an unsaturated carboxylic acid monomer or a polymerizable derivative thereof and (b-1) an alkylene oxide adduct of an aliphatic compound or an aromatic compound, (b-2) a sulfonate of a monocyclic compound or a condensed polycyclic compound or (b-3) an aliphatic aldehyde condensate of said sulfonate.

12 Claims, No Drawings

DETERGENT COMPOSITION FOR CLEANING DYEING MACHINE

The present invention relates to a detergent for cleaning dyeing machines. More particularly, the invention relates to a detergent suitable for use in cleaning dyeing machines at the time of the switchover of dyeing lots.

A dyeing machine (particularly a vessel) is cleaned when a dyeing lot is switched over in dye works because if the machine is not cleaned, a dye, dyeing assistant and contaminants contained in the water used in the preceding lot and remaining on the walls of the dyeing machine would be incorporated in a dyeing bath in the subsequent dyeing lot to cause contamination of the dyeing system, changes in the hue of the fibrous product to be dyed or uneven dyeing thereof or to adhere the contaminates to the fibers, thus inviting troubles such as conversion of the fibers into being hydrophobic or rough and, stiff.

The cleaning process varies depending on the degree of staining of the dyeing machine and the subsequent dyeing process. For example, it has been considered that the cleaning of a dyeing vessel is unnecessary when a vessel not stained severely in the preceding lot is used again in the subsequent lot in which a dye of a higher concentration is used as in the case where a cotton is dyed with a reactive dye into a pale color and then with a reactive dye into a similar, darker color. However, even in such a case, the vessel is stained with the dye, etc. which might exert an adverse influence on the dyeing in the subsequent dyeing lot and, therefore, the vessel should be cleaned with a suitable detergent. A thorough washing is necessary when the vessel is stained severely in the preceding lot and the dye concentration in the subsequent lot is low as in the case when polyester fibers are dyed into a dark color with a disperse dye and then into a pale color with a disperse dye. In this case, the vessel is cleaned with a combination of a detergent for the vessel, an alkali and a hydrosulfite at a high temperature. Examples of the detergents for the vessel include aliphatic amine/alkylene oxide adducts, alkylphenol/alkylene oxide adducts, arylphenol/alkylene oxide adducts, fatty acid/alkylene oxide adducts, products obtained by adding an alkylene oxide to a mixture of a fatty acid triglyceride and a polyhydric alcohol, alkylbetaines and quaternary ammonium salts.

However, the contaminants in the vessel are composite materials produced by the reaction of the dye, dye assistant and impurities in water used and, therefore, they cannot be removed thoroughly by the detergent for cleaning the dyeing vessel which has only the above-mentioned functions. Thus, in fact, problems are posed that the vessel must be cleaned by repeating the cleaning under the severe conditions as described above or by dyeing waste fibers to remove the dye, etc. remaining in the vessel. Further, it is considered that a tendency of producing varieties of products each in a small amount is increasing and the ratio of the cleaning time to the working time is also increasing. In addition, the bath ratio is now being reduced from the viewpoint of saving energy and resources to pose a problem that the staining of the vessel is accelerated by the increase of the concentration of the contaminants in the dyeing bath. To solve these problems, the development of detergents for cleaning the vessel superior to those used in the prior art is demanded.

Summary of the Invention

After intensive investigations made for the purpose of solving the above-mentioned technical problems, the inventors have found that the problems can be solved by using a composition comprising components described below as the detergent for the dyeing machines.

The invention provides a detergent composition, suitable to clean a dyeing machine, which comprises (a) a water-soluble or water-dispersible polymer of an unsaturated carboxylic acid monomer or a polymerizable derivative thereof and (b-1) an alkylene oxide adduct of an aliphatic compound or an aromatic compound, (b-2) a sulfonate of a monocyclic compound or a condensed polycyclic compound or (b-3) an aliphatic aldehyde condensate of said sulfonate.

An embodiment of the invention comprises the component (a) and as the component (b) (b-1)and one of (b-2) and (b-3) in combination.

It is optional that said polymer (a) is a copolymer of said two or more monomers. Said derivative may be an alkyl(C1 to C4) ester, an alkali metal salt, an ammonium salt or an organic amine salt of said acid. It is also optional said polymer (a) is a copolymer of said monomer and another monomer.

The invention moreover provides a method for cleaning a dyeing machine with a detergent composition as defined above.

The invention composition is alternatively defined below. It comprises:

(a) a water-soluble or water-dispersible polymer comprising one or more monomers selected from the group consisting of unsaturated carboxylic acids and their derivatives as indispensable component(s), and (b) an alkylene oxide adduct of an aliphatic or aromatic compound and/or a sulfonated monocyclic or condensed polycyclic compound, or an aliphatic aldehyde condensate thereof.

Examples of the monomers usable for obtaining the above-mentioned component (a) include unsaturated monocarboxylic acids such as acrylic and methacrylic acids; unsaturated dicarboxylic acids such as maleic acid; derivatives of the acids such as alkyl esters (e.g. methyl esters), alkali metal salts (e.g. sodium salts), ammonium salts and organic amine salts (e.g. triethanolamine salts) of said acids; and mixtures of them. In addition to these monomers, copolymerizable monomers such as vinyl acetate, isobutylene, diisobutylene and styrene may also be used as comonomer components.

These monomers are polymerized by a known, ordinary process. Though the proportion of the monomers and the degree of polymerization of them are not particularly limited, the polymer should be at least water-soluble or water-dispersible.

Examples of the polymers include polyacrylic acid, polymethacrylic acid, acrylic acid/methacrylic acid copolymer, acrylic acid/methyl acrylate copolymer, acrylic acid/vinyl acetate copolymer, acrylic acid/-maleic acid copolymer, maleic acid/isobutylene copolymer and maleic acid/styrene copolymer as well as salts of them with alkali metals, ammonia and organic amines. These polymers may be used either alone or in the form of a mixture of two or more of them. The preferred polymers and copolymers used as the component (a) of the present invention are those having an average molecular weight of 1,000 to 10,000.

Examples of the alkylene oxide adducts of the aliphatic or aromatic compounds used as the component (b) in the present invention include alkylene oxide adducts of aliphatic amines, alkylphenols, arylphenols, nonylphenol, fatty acids, fatty acid triglycerides and mixtures of a fatty acid triglyceride with a polyhydric alcohol.

Examples of the sulfonated monocyclic and condensed polycyclic compounds and aliphatic aldehyde condensates of them usable as the compound (b) in the present invention include aromatic hydrocarbons such as benzene, naphthalene, fluorene, anthracene, phenanthrene, pyrene, naphthacene, pentacene, coronene, hexene, heptacene, octacene, nonacene, decene, undecacene, dodecacene and acenaphthene; aromatic hydrocarbon mixtures such as creosote oil and cracking products of petroleum; and water-soluble salts of them such as alkali metal, ammonium, alkaline earth metal and alkanolamine salts of them prepared by condensing a sulfonated aromatic compound including derivatives having 1 or 2 alkyl groups having 1 to 5 carbon atoms with formalin. Among them, formalin condensates of naphthalenesulfonic acid salts, ligninsulfonic acid salts and alkylnaphthalene-sulfonic acid salts in which the alkyl group has 1 to 8 carbon atoms are particularly preferred.

The detergent of the present invention for cleaning dyeing machines comprises the combination of the above-mentioned components (a) and (b). By using this combination, the problems of the conventional detergents for dyeing machines can be solved.

The detergent of the present invention for cleaning dyeing machines contains preferably at least 1 wt. % of the component (a), particularly at least 5 wt. % of the same.

Namely, the mixing weight ratio of (a) to (b) is in the range of 1 to 99/99 to 1, particularly 5 to 99/95 to 1.

The detergent of the present invention is used in an amount of 0.01 to 20 g (in terms of the solid), preferably 0.04 to 10 g per 1 liter of water which dissolves the same. The cleaning is practically made while the detergent solution is stirred. The deterging power of the composition is advantageously increased by adding thereto a reducing agent such as a hydrosulfite, a condensate between hydrosulfite and formaldehyde, hydroxyethanesulfinic acid and sodium boron hydride and an alkali agent such as sodium hydroxide and potassium hydroxide.

Though the mechanism of cleaning the dyeing machines thoroughly with the detergent of the present invention has not fully been understood yet, it may be supposed that the scales deposited on the walls of the dyeing machines are dispersed and removed by high chelating capacity and inorganic substance-dispersing capacity of the component (a) and that the non-fixed dye, reaction products thereof with the alkali and tarry products are removed from the walls of the dyeing machine and redeposition of them is prevented by dye-solubilizing capacity, cleaning power and organic substance-dispersing capacity of the component (b). Thus, thorough cleaning can be effected.

Each component to use in the invention composition can be obtained by a conventional preparation process. For example, an acrylic polymer, one of the component (a), can be prepared by adding acrylic acid and ammonium persulfate dropwise to an aqueous solution of iso-propyl alcohol. Sodium salt of a copolymer of acrylic acid and maleic anhydride, another example of the component (a), can be obtained by conducting the aqueous solution polymerization of sodium neutralized products of acrylic acid and maleic anhydride in the presence of ammonium persulfate. The component (b-1) can be prepared by conducting the addition reaction of an alkylene oxide to an aliphatic compound or an aromatic compound at a high pressure at a high temperature. Naphthalene sulfonate, one of the (b-2), can be obtained by a reaction between naphthalene and concentrated sulfuric acid. Then a condensate thereof, one of the (b-3), can be prepared by addition of formalin to the sulfonate and heating of the mixture.

The following composition examples and examples of the detergents will further illustrate the present invention, which by no means limit the invention.

(COMPOSITION EXAMPLES)

The detergents for cleaning dyeing machines having compositions shown in Table 1 were used.

(EXAMPLES)

Polyester cloths (Tropical) were dyed with the following dye A at 130° C. in a high-pressure which dyeing machine (a product of Tsujii Senki Kogyo Co., Ltd.) for 30 min with a bath ratio of 1/10 and then the vessel was cleaned at 100° C. under the following conditions B for 30 min:

| | |
|---|---|
| A. C. I. Disperse Red 143, | 3 g/L, pH 4 (adjusted with acetic acid) |
| B. detergent for vessel | 2 g/L |
| sodium hydroxide | 1 g/L |
| sodium hydrosulfite | 1 g/L |

The extent of cleanness of the vessel was determined by effecting a blank dyeing test of white polyester cloths (Tropical) in tap water controlled to pH 4 with acetic acid at 130° C. for 30 min in the high-pressure winch dyeing machine after the cleaning and then examining the degree of coloring of the white cloths. The results are shown in Table 2.

A coloring degree is shown with 9 grades, 1, 1-2, 2,-3, 3,-4, 4,-5, 5. The grade 5 means that a test cloth is not colored and the grade 1 means that it is the most colored. It is accordingly noted that the stronger the detergency is, the higher the coloring degree is.

TABLE 1

(unit: wt. %)

| Components | Detergent of the present invention for cleaning the vessel | | | | | | | | |
|---|---|---|---|---|---|---|---|---|---|
| | 1 | 2 | 3 | 4 | 5 | 6 | 7 | 8 | 9 |
| (1) polysodium acrylate (molecular weight: about 6000) | 25 | 25 | 30 | 30 | 40 | 50 | 50 | 80 | 90 |
| (2) sodium salt of naphthalenesulfonic acid/formalin condensate | 15 | — | 20 | — | 40 | — | — | — | 10 |
| ammonium salt of naphthalenesulfonic acid/formalin condensate | — | 15 | — | 20 | — | 50 | — | — | — |
| (3) EO (15 mol) adduct of mixture of bone oil and glycerol | 60 | — | — | 50 | 20 | — | — | 20 | — |
| EO (13 mol) adduct of styrenated phenol | — | 60 | 50 | — | — | — | 50 | — | — |

TABLE 2

| Detergent for the vessel | Degree of coloring of white cloth (grade) |
|---|---|
| Present invention | |
| Composition 1 | 4–5 |
| Composition 2 | 4–5 |
| Composition 3 | 4–5 |
| Composition 4 | 4–5 |
| Composition 5 | 4–5 |
| Composition 6 | 4 |
| Composition 7 | 4–5 |
| Composition 8 | 4–5 |
| Composition 9 | 4 |
| Comparative detergent 1 | 2–3 |
| Comparative detergent 2 | 3 |
| Comparative detergent 3 | 3 |
| Comparative detergent 4 | 3 |
| Comparative detergent 5 | 3 |
| None | 2 |

comparative detergent 1: ammonium salt of naphthalenesulfonic acid/formalin condensate,
comparative detergent 2: EO (15 mol) adduct of a mixture of bone oil and glycerol,
comparative detergent 3: EO (13 mol) adduct of styrenated phenol,
comparative detergent 4: laurylbetaine
comparative detergent 5: polysodium acrylate (molecular weight: about 6,000).

[EFFECTS OF THE INVENTION]

When the detergent of the present invention for cleaning dyeing machines is used, the dyeing vessel can be cleaned thoroughly in a short time at the time of the switchover of dyeing lots as shown in the above examples. This effect can be obtained because the detergent of the present invention for cleaning dyeing machines contains, as an indispensable component, a water-soluble or water-dispersible polymer comprising one or more monomers selected from the group consisting of unsaturated carboxylic acids and their derivatives as indispensable component(s).

The emobidments of the invention in which an exclusive property or privilege is claimed are defined as follows:

1. In a method for removing residual dyes and water impurity residues comprising contacting the surfaces of a dyeing machine with a detergent composition, the improvement wherein said detergent composition comprises (a) a water-soluble or water-dispersible polymer of an unsaturated carboxylic acid monomer or a polymerizable derivative thereof and at least one of (b-1) an alkylene oxide adduct of an aliphatic compound or an aromatic compound, (b-2) a sulfonate of a monocyclic compound or a condensed polycyclic compound or (b-3) an aliphatic aldehyde condensate of said sulfonate.

2. The method of claim 1, wherein said detergent composition comprises (a), (b-1) and one of (b-2) and (b-3) in combination.

3. The method of claim 1, wherein said polymer (a) is a copolymer of said two or more monomers.

4. The method of claim 1 wherein said derivative is an alkyl(C1 to C4) ester, an alkali metal salt, an ammonium salt or an organic amine salt of said acid.

5. The method of claim 1, wherein said polymer is a copolymer of said monomer and another monomer.

6. The method of claim 1, wherein said polymer an average has a molecular weight of 1,000 to 10,000.

7. The method fo claim 1, wherein said condensate is an alkali metal salt, an alkaline earth metal salt or an alkanolamine salt, and is water-soluble.

8. The method of claim 1, wherein said condensate is a formaldehyde condensate of a naphthalenesulfonic acid slat, a formaldehyde condensate of a ligninsulfonic acid salt or a formaldehyde condensate of an alkylnaphthalenesulfonate salt having 1 to 8 carbon atoms in the alkyl group.

9. The method of claim 1, wherein the weight ratio of (a) to (b-1), (b—2) and/or (b-3) ranges from 1/99 to 99/1, said (a) is contained in an amount of at least 1 percent by weight and the total amount of (a), (b-1), (b-2) and (b-3) ranges from 0.01 to 20 g as a solid per 1 liter of water, the balance being water.

10. A method as claimed in claim 1 which comprises washing the surfaces of said dyeing machine with an aqueous solution of said detergent composition, said aqueous solution containing from 0.01 to 20 g of said detergent composition, calculated as the solids, per liter of said solution.

11. A method as claimed in claim 10 in which said aqueous solution consists essentially of (a) plus (b-1), (b-2) and/or (b-3), a reducing agent and an alkali.

12. A method as claimed in claim 10 in which the walls of said dyeing machine have deposited thereon scales of the residues of a previous dyeing procedure, and wherein said aqueous solution is placed in said dyeing machine and is stirred to remove said scales from said walls.

* * * * *

UNITED STATES PATENT AND TRADEMARK OFFICE

CERTIFICATE OF CORRECTION

PATENT NO. : 4 732 697

DATED : March 22, 1988

INVENTOR(S) : Naoki KYOCHIKA et al

It is certified that error appears in the above-identified patent and that said Letters Patent is hereby corrected as shown below:

Column 6, line 16; after "polymer" insert ---has---.
line 17; delete "has a".

Column 6, line 18; change "fo" to ---of---.

Column 6, line 23; change "slat" to --- salt ---.

Signed and Sealed this

Twentieth Day of September, 1988

*Attest:*

DONALD J. QUIGG

*Attesting Officer*

*Commissioner of Patents and Trademarks*